US005330960A

United States Patent [19]

Ono et al.

[11] Patent Number: 5,330,960

[45] Date of Patent: Jul. 19, 1994

[54] HEAT TRANSFER SHEET

[75] Inventors: Masashi Ono; Shigeo Yasui; Ayashi Noguchi, all of Okayama; Ryohei Takiguchi, Tokyo; Hiroshi Eguchi, Tokyo; Komei Kafuku, Tokyo, all of Japan

[73] Assignee: Dai Nippon Printing Co., Ltd., Japan

[21] Appl. No.: 858,982

[22] PCT Filed: Sep. 25, 1991

[86] PCT No.: PCT/JP91/01273

§ 371 Date: May 21, 1992

§ 102(e) Date: May 21, 1992

[87] PCT Pub. No.: WO92/05032

PCT Pub. Date: Apr. 2, 1992

[30] Foreign Application Priority Data

Sep. 25, 1990 [JP] Japan ..... 2-255512

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,062,845 | 12/1977 | Schefczik | 260/256.5 |
| 4,080,331 | 3/1978 | Brack | 260/326.62 |

FOREIGN PATENT DOCUMENTS

| | | | |
|---|---|---|---|
| 0178832 | 4/1986 | European Pat. Off. | 503/227 |
| 0257580 | 3/1988 | European Pat. Off. | 428/195 |
| 2429760 | 1/1976 | Fed. Rep. of Germany | 428/195 |
| 2014429 | 4/1970 | France | 428/195 |
| 2246687 | 5/1975 | France | 260/326.62 |
| 61-141593 | 6/1986 | Japan | 503/227 |
| 63-170092 | 7/1988 | Japan | 503/227 |

*Primary Examiner*—B. Hamilton Hess

*Attorney, Agent, or Firm*—Parkhurst, Wendel & Rossi

[57] ABSTRACT

A dye and a heat transfer sheet for use in a heat transfer printing method employing a sublimable dye, capable of producing an image which has a sufficiently high density and is excellent in sharpness, fastness properties and, in particular, resistance to light are provided. The dye has the following formula (I):

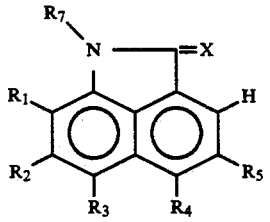

The heat transfer sheet includes a substrate sheet, and a dye layer including the dye having formula (I), provided on one surface of the substrate sheet.

4 Claims, No Drawings

HEAT TRANSFER SHEET

TECHNICAL FIELD

The present invention relates to a dye useful for heat transfer printing and a heat transfer sheet comprising the dye. More specifically, the present invention relates to a heat transfer sheet capable of producing an image which is excellent in color density, sharpness and fastness properties, and in particular, an image which is excellent in resistance to light (fastness to light) and is free from migration to the reverse side of an image-receiving sheet.

BACKGROUND ART

Heretofore, a variety of heat transfer printing methods have been known. Of these methods, a sublimation-type heat transfer printing method is now prevailing. In this method, a heat transfer sheet comprising as a coloring agent (printing agent) a sublimable dye which is retained by a substrate sheet such as paper is superposed on a heat transfer image-receiving sheet such as polyester woven cloth which can be dyed with the sublimable dye, and thermal energy is applied imagewise to the back surface of the heat transfer sheet to transfer the sublimable dye to the heat transfer image-receiving sheet, thereby producing an image on the image-receiving sheet.

Recently, there has been proposed a heat transfer printing method of the sublimation type, capable of producing various full-colored images on an image-receiving sheet such as a sheet of paper or a plastic film. In this method, a thermal head of a printer is employed as a heat application means, and a large number of dots in three or four colors are transferred to the image-receiving sheet in an extremely short heat application time. A full-colored image can thus be successfully reproduced on the image-receiving sheet.

The image thus obtained is very sharp and excellent in transparency because a dye is used as a coloring agent. Therefore, the heat transfer printing method of this type can produce an excellent half-tone image with continuous gradation, comparable to an image obtained by offset printing or gravure printing. Moreover, the quality of the image is as high as that of a full-colored photograph.

However, the image produced by the above heat transfer printing method is poor in both color density (image density) and resistance to light. This is a serious problem in this method.

To conduct high-speed printing, it is required that thermal energy be applied to the heat transfer sheet in an extremely short time of several seconds or less. However, both the sublimable dye contained in the heat transfer sheet and the heat transfer image-receiving sheet are not thoroughly heated within such a short heat application time. The resulting image, therefore, cannot have a sufficiently high density.

A sublimable dye which is excellent in sublimation ability has been developed in order to successfully conduct high-speed printing. In general, however, a highly sublimable dye has a low molecular weight. Fro this reason, an image produced on an image-receiving sheet using such a dye is poor in resistance to light, and the color of the image fades easily.

To solve the above problem, a sublimable dye having a relatively high molecular weight may be employed. Such a sublimable dye, however, cannot sublime instantly when heat is applied thereto, so that an image having a satisfactorily high density cannot be obtained by the above high-speed printing method.

Accordingly, an object of the present invention is to provide a dye and a heat transfer sheet for use in a heat transfer printing method employing a sublimable dye, capable of producing an image which has a sufficiently high density and is excellent in sharpness, fastness properties, and, in particular, resistance to light.

DISCLOSURE OF THE INVENTION

The above object can be accomplished by the below-described invention. Namely, the present invention provides a dye for heat transfer printing (hereinafter may be referred to simply as a dye) having the following formula (I), and a heat transfer sheet comprising (i) a substrate sheet and (ii) a dye layer comprising a dye having formula (I), provided on one surface of the substrate sheet.

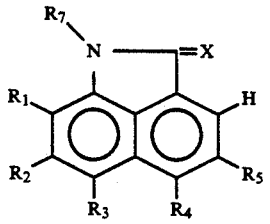

wherein

X is

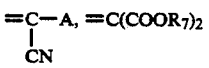

($R_7S$ may be the same or different), or

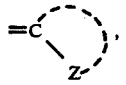

in which

A is an electron attracting group,

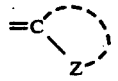

is a residual group of five- or six-membered ring which is represented by

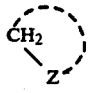

and may have a condensed ring, and Z is —CO—, —$NR_6$—, —S—, —O— or —NH—, $R_1$ is a hydrogen atom, $R_6$, a halogen atom, a nitro group, —$OR_6$, —$SR_6$ or an allyl group which may have a substituent, $R_2$ is a hydrogen atom, a halogen atom, —$OR_6$ or —$SR_6$, $R_3$ is a hydrogen atom, $R_6$, a halogen atom, a nitro group, an allyl group which may have a substituent, —$OR_6$, —$SR_6$, a sulfamoyl group, a carbamoyl group, an acyl group, an acylamide group, a sulfone amide group, an ureido group or —$NR_6R_6$($R_6S$ may be the same or different), $R_4$ is a hydrogen atom, a halogen atom, —$OR_6$, —$SR_6$, a cyano group, —$COOR_6$, a carbamoyl group or a sulfamoyl group, $R_5$ is a hydrogen atom, a halogen atom, —$OR_6$ or —$SR_6$, $R_6$ is an alkyl group which may have a substituent, an aryl group which may have a substituent, a cycloalkyl group which may have a substituent or a heterocyclic ring which may have a substituent, $R_7$ is a hydrogen atom, —$R_6$, an allyl group which may have a substituent, an alkenyl group which may have a substituent, a heteroalkenyl group which may have a substituent, an arylalkyl group which may have a substituent, a heteroarylalkyl group which may have a substituent, an alkoxyalkyl group which may have a substituent, an oxycarbonylalkyl group which may have a substituent, a carboxyalkyl group which may have a substituent, an oxycarboxyalkyl group which may have a substituent or a cycloalkylalkyl group which may have a substituent, and any two adjacent groups among $R_1$, $R_2$, $R_3$, $R_4$ and $R_5$ may form a ring.

By the use of the dye with a specific structure, a heat transfer sheet that can produce an image even when thermal energy is applied thereto in an extremely short time and that can produce an image which has a high density and is excellent in fastness properties, and, in particular, resistance to light can be obtained.

BEST MODE FOR CARRING OUT THE INVENTION

The present invention will now be explained in detail by referring to the preferred embodiments.

The dye having formula (I) for use in the present invention is readily obtainable by a known method such as a method in which a benz[cd]indole-2(1H)one derivative represented by the following formula:

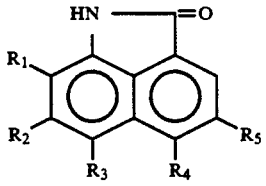

is subjected to N-alkylation, and the resulting compound is subjected to dehydration condensation with an active methylene compound to obtain a desired dye, or a method in which $R_1$ to $R_5$ groups are introduced to benz[cd]indole-2(1H)one which has been subjected to N-alkylation in advance, and the resulting compound is subjected to dehydration condensation with an active methylene compound to obtain a desired dye. The other dyes which will be described below can also be synthesized in the same manner as the above.

Preferable examples of the dye having formula (I) are specifically shown in Tables 1 to 6. By using the dyes shown in the tables, heat transfer sheets were respectively prepared in the manner which will be described later. An image was produced using each of the heat transfer sheets, and the color density and resistance to light thereof were determined. The results are also shown in Tables 1 to 6.

Dye I-1

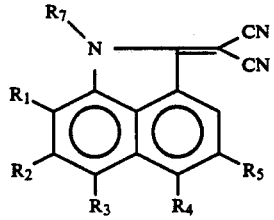

Dye I-2

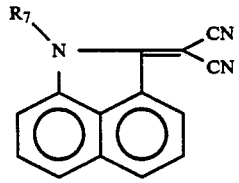

Dye I-3

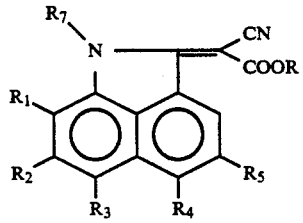

Dye I-4

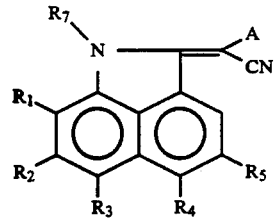

Dye I-5

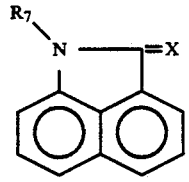

Dye I-6

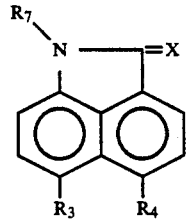

TABLE 1

(Dye I-1)

| No. | $R_1$ | $R_2$ | $R_3$ | $R_4$ | $R_5$ | $R_7$ | Hue | Density | Resistance to light |
|---|---|---|---|---|---|---|---|---|---|
| 1 | —H | —H | —H | —H | —H | —$C_4H_9$ | yellow | 1.50 | ⊚ |
| 2 | —H | —H | —H | —H | —H | —$C_8H_{17}$ | yellow | 1.60 | ⊚ |
| 3 | —H | —H | —H | —H | —H | —$C_{10}H_{21}$ | yellow | 2.12 | ⊚ |
| 4 | —H | —H | —H | —H | —H | —$C_2H_4$ph | yellow | 1.61 | ⊚ |
| 5 | —$CH_3$ | —H | —$CH_3$ | —H | —H | —$C_4H_9$ | yellow | 1.58 | ⊚ |
| 6 | —Cl | —H | —H | —H | —H | —$C_4H_9$ | yellow | 1.52 | ⊚ |
| 7 | —$NO_2$ | —H | —H | —H | —H | —$C_4H_9$ | yellow | 1.63 | ⊚ |
| 8 | —$CH_2CH{=}CH_2$ | —H | —H | —H | —H | —$C_4H_9$ | yellow | 1.54 | ⊚ |
| 9 | —Sph | —H | —H | —H | —H | —$C_4H_9$ | yellow | 1.72 | ⊚ |
| 10 | —$SC_2H_5$ | —H | —H | —H | —H | —$C_4H_9$ | yellow | 1.50 | ⊚ |
| 11 | —$OC_2H_5$ | —H | —$CH_3$ | —H | —H | —$C_4H_9$ | yellow | 1.48 | ⊚ |
| 12 | —H | —Cl | —Cl | —H | —H | —$C_4H_9$ | yellow | 1.49 | ⊚ |
| 13 | —H | —Sph | —Sph | —H | —H | —$C_4H_9$ | yellow | 1.62 | ⊚ |
| 14 | —H | —$OC_2H_5$ | —H | —H | —Cl | —$C_4H_9$ | yellow | 1.55 | ⊚ |
| 15 | —H | —H | —H | —H | —H | —$C_4H_8OH$ | yellow | 1.62 | ⊚ |
| 16 | —H | —H | —H | —H | —H | —$C_6H_{12}OH$ | yellow | 1.74 | ⊚ |
| 17 | —H | —H | —H | —H | —H | —$C_8H_{16}OH$ | yellow | 1.78 | ⊚ |
| 18 | —H | —H | —H | —H | —H | —$C_{10}H_{22}OH$ | yellow | 2.26 | ⊚ |
| 19 | —H | —H | —ph | —H | —H | —$C_4H_9$ | yellow | 1.62 | ⊚ |
| 20 | —H | —H | -2-pyridyl- | —H | —H | —$C_4H_9$ | yellow | 1.64 | ⊚ |
| 21 | —H | —H | —$CH_2Ph$ | —H | —H | —$C_4H_9$ | yellow | 1.43 | ⊚ |
| 22 | —H | —H | -cyclohexyl- | —H | —H | —$C_4H_9$ | yellow | 1.69 | ⊚ |
| 23 | —H | —H | -2-thienyl- | —H | —H | —$C_4H_9$ | yellow | 1.48 | ⊚ |
| 24 | —OPh | —H | —H | —$COOC_2H_5$ | —H | —Ph | yellow | 1.73 | ⊚ |
| 25 | —H | —H | —H | —H | —H | —$(C_2H_4O)_2C_4H_9$ | yellow | 1.96 | ⊚ |
| 26 | —H | —H | —H | —H | —Cl | —$C_2H_4OPh$ | yellow | 1.82 | ⊚ |
| 27 | —H | —H | —$SC_2H_5$ | —H | —H | —$C_2H_4OCOCH_3$ | yellow | 1.77 | ⊚ |
| 28 | —H | —H | (2-Pyridyl)-S- | —H | —H | —$C_2H_4COOC_2H_5$ | yellow | 1.74 | ⊚ |
| 29 | —H | —H | —$NO_2$ | —H | —H | —$C_2H_4OCOPh$ | yellow | 1.83 | ⊚ |
| 30 | —H | —H | —$SO_2NHCH_3$ | —H | —H | —$C_2H_4OCOOPh$ | yellow | 1.64 | ⊚ |
| 31 | —H | —H | —Cl | —Cl | —H | —$(C_2H_4O)_2C_2H_5$ | yellow | 1.86 | ⊚ |
| 32 | —H | —H | —$CH_2CH{=}CH_2$ | —H | —H | —$C_4H_9$ | yellow | 1.48 | ⊚ |
| 33 | —H | —H | —$CONHCH_3$ | —H | —H | —$C_4H_9$ | yellow | 1.46 | ⊚ |
| 34 | —H | —H | —CONHPh | —H | —H | —$C_4H_9$ | yellow | 1.56 | ⊚ |
| 35 | —H | —H | —$COCH_3$ | —H | —H | —$C_4H_9$ | yellow | 1.51 | ⊚ |
| 36 | —H | —H | —CoPh | —H | —H | —$C_4H_9$ | yellow | 1.57 | ⊚ |
| 37 | —H | —H | —$NHCOCH_3$ | —H | —H | —$C_4H_9$ | yellow | 1.51 | ⊚ |
| 38 | —H | —H | —$NHSO_2CH_3$ | —H | —H | —$C_4H_9$ | yellow | 1.49 | ⊚ |
| 39 | —H | —H | —$NHCONHCH_3$ | —H | —H | —$C_4H_9$ | yellow | 1.38 | ⊚ |
| 40 | —H | —H | —$N(CH_3)_2$ | —H | —H | —$C_4H_9$ | yellow | 1.42 | ⊚ |
| 41 | —H | —H | —$N(CH_3)C_2H_4Ph$ | —H | —H | —$C_4H_9$ | yellow | 1.59 | ⊚ |
| 42 | cyclohexyl-O- | —H | —H | —H | —H | —$C_4H_9$ | yellow | 1.62 | ⊚ |
| 43 | (2-furyl)-O- | —H | —H | —H | —H | —$C_4H_9$ | yellow | 1.57 | ⊚ |
| 44 | —H | cyclohexyl-S- | —H | —H | —H | —$C_4H_9$ | yellow | 1.53 | ⊚ |
| 45 | —H | (2-pyridyl)-S- | —H | —H | —H | —$C_4H_9$ | yellow | 1.58 | ⊚ |
| 46 | —H | —$SC_2H_5$ | —H | —H | —H | —$C_4H_9$ | yellow | 1.41 | ⊚ |
| 47 | —H | —OPh | —H | —H | —H | —$C_4H_9$ | yellow | 1.63 | ⊚ |
| 48 | —H | (2-pyridyl)-O- | —H | —H | —H | —$C_4H_9$ | yellow | 1.66 | ⊚ |
| 49 | —H | —H | —$OC_2H_5$ | —H | —H | —$C_4H_9$ | yellow | 1.57 | ⊚ |
| 50 | —H | —H | —OPh | —H | —H | —$C_4H_9$ | yellow | 1.66 | ⊚ |
| 51 | —H | —H | cyclohexyl-O- | —H | —H | —$C_4H_9$ | yellow | 1.72 | ⊚ |
| 52 | —H | —H | (2-pyridyl)-O- | —H | —H | —$C_4H_9$ | yellow | 1.58 | ⊚ |
| 53 | —H | —H | cyclohexyl-S- | —H | —H | —$C_4H_9$ | yellow | 1.82 | ⊚ |
| 54 | —H | —H | (2-pyridyl)-S- | —H | —H | —$C_4H_9$ | yellow | 1.66 | ⊚ |
| 55 | —H | —H | —H | —$OC_2H_5$ | —H | —$C_4H_9$ | yellow | 1.38 | ⊚ |
| 56 | —H | —H | —H | —OPh | —H | —$C_4H_9$ | yellow | 1.45 | ⊚ |
| 57 | —H | —H | —H | —$SC_2H_5$ | —H | —$C_4H_9$ | yellow | 1.47 | ⊚ |
| 58 | —H | —H | —H | —SPh | —H | —$C_4H_9$ | yellow | 1.41 | ⊚ |
| 59 | —H | —H | —H | —CN | —H | —$C_4H_9$ | yellow | 1.52 | ⊚ |
| 60 | —H | —H | —H | —$CONHCH_3$ | —H | —$C_4H_9$ | yellow | 1.47 | ⊚ |
| 61 | —H | —H | —H | —$SO_2NHCH_3$ | —H | —$C_4H_9$ | yellow | 1.45 | ⊚ |
| 62 | —H | —H | —H | (2-pyridyl)-S- | —H | —$C_4H_9$ | yellow | 1.62 | ⊚ |
| 63 | —H | —H | —H | cyclohexyl-S- | —H | —$C_4H_9$ | yellow | 1.63 | ⊚ |
| 64 | —H | —H | —H | (2-furyl)-O- | —H | —$C_4H_9$ | yellow | 1.57 | ⊚ |
| 65 | —H | —H | —H | cyclohexyl-O- | —H | —$C_4H_9$ | yellow | 1.56 | ⊚ |
| 66 | —H | —H | —H | —H | —$OC_2H_5$ | —$C_4H_9$ | yellow | 1.42 | ⊚ |
| 67 | —H | —H | —H | —H | —OPh | —$C_4H_9$ | yellow | 1.38 | ⊚ |
| 68 | —H | —H | —H | —H | cyclohexyl-O- | —$C_4H_9$ | yellow | 1.47 | ⊚ |
| 69 | —H | —H | —H | —H | (2-pyridyl)-O- | —$C_4H_9$ | yellow | 1.43 | ⊚ |
| 70 | —H | —H | —H | —H | —$SC_2H_5$ | —$C_4H_9$ | yellow | 1.39 | ⊚ |
| 71 | —H | —H | —H | —H | —SPh | —$C_4H_9$ | yellow | 1.55 | ⊚ |
| 72 | —H | —H | —H | —H | cyclohexyl-S- | —$C_4H_9$ | yellow | 1.53 | ⊚ |
| 73 | —H | —H | —H | —H | (2-pyridyl)-O- | —$C_4H_9$ | yellow | 1.47 | ⊚ |
| 74 | —H | —H | —$CH{=}C(CN)_2$ | —H | —H | —$C_2H_5$ | yellow | 1.44 | ⊚ |
| 75 | —H | —H | —H | —H | —H | —$C_2H_5$ | yellow | 1.24 | ⊚ |
| 76 | —H | —H | —H | —H | —$OCH_3$ | —$C_4H_9$ | yellow | 1.59 | ⊚ |
| 77 | —H | —H | -t-$C_4H_9$ | —H | —H | —$C_2H_5$ | yellow | 1.72 | ⊚ |

TABLE 1-continued (Dye I-1)

| No. | $R_1$ | $R_2$ | $R_3$ | $R_4$ | $R_5$ | $R_7$ | Hue | Density | Resistance to light |
|---|---|---|---|---|---|---|---|---|---|
| 78 | —H | —H | —H | —H | —$OCH_2Ph$ | —$C_2H_5$ | yellow | 1.70 | ◎ |

TABLE 2

(Dye I-2)

| No. | $R_7$ | Hue | Density | Resistance to light |
|---|---|---|---|---|
| 1 | —$(C_2H_4O)_3C_2H_5$ | yellow | 2.04 | ◎ |
| 2 | -iso-$C_3H_7$ | yellow | 1.58 | ◎ |
| 3 | cyclohexyl- | yellow | 1.86 | ◎ |
| 4 | 2,4-dichlorobenzyl- | yellow | 1.94 | ◎ |
| 5 | 2-pyridyl- | yellow | 1.73 | ◎ |
| 6 | 2-(6-methylpyridyl)- | yellow | 1.81 | ◎ |
| 7 | 2-pyridylmethyl- | yellow | 1.94 | ◎ |
| 8 | 2,4,6-trichlorobenzyl- | yellow | 2.26 | ◎ |
| 9 | 4-ethoxycarbonylbenzy- | yellow | 1.93 | ◎ |
| 10 | 2-ethoxycarbonylbenzyl- | yellow | 1.86 | ◎ |
| 11 | —$C_2H_4CN$ | yellow | 1.47 | ◎ |
| 12 | 2-(pyridyl)ethyl- | yellow | 1.73 | ◎ |
| 13 | 2-chlorophenyl- | yellow | 1.67 | ◎ |
| 14 | 4-chlorophenyl- | yellow | 1.83 | ◎ |
| 15 | 2,4-dichlorophenyl- | yellow | 1.96 | ◎ |
| 16 | 4-hydroxyphenethyl- | yellow | 1.87 | ◎ |
| 17 | 2-methylphenethyl- | yellow | 1.92 | ◎ |
| 18 | 3-methylphenethyl- | yellow | 1.94 | ◎ |
| 19 | 4-methylphenethyl- | yellow | 1.88 | ◎ |
| 20 | —$CH_2COOCH_2COOC_2H_5$ | yellow | 1.65 | ◎ |
| 21 | —$CH_2COOCH_2Ph$ | yellow | 1.77 | ◎ |
| 22 | 4-ethoxycarbonylphenoxy-carbonylmethyl- | yellow | 1.75 | ◎ |
| 23 | 4-cyclohexyoxycarbonylphenoxy-carbonylmethyl- | yellow | 1.86 | ◎ |
| 24 | 4-cyclohexylphenoxycarbonyl-methyl- | yellow | 1.73 | ◎ |
| 25 | —$CH_2CONHC_6H_{13}$ | yellow | 1.65 | ◎ |
| 26 | $CH_2SO_2NHC_6H_{13}$ | yellow | 1.58 | ◎ |
| 27 | 4-(2-hydroxyethyl)benzyl- | yellow | 1.56 | ◎ |
| 28 | 4-[2-(2-hydroxyethoxy)ethyl]benzyl- | yellow | 1.64 | ◎ |
| 29 | 2-[2-(2-hydroxyethoxy)ethyl]-benzyl- | yellow | 1.83 | ◎ |
| 30 | 2-[4-(2-hydroxyethyl)phenoxy]-ethoxyethyl- | yellow | 1.79 | ◎ |
| 31 | 4-[2-[2-(2-hydroxyethoxy)ethyl]-phenyl]butyl- | yellow | 1.88 | ◎ |
| 32 | 3-[4-[2-(2-hydroxyethoxy)ethyl]-phenoxycarbonyl]propyl- | yellow | 1.83 | ◎ |
| 33 | 4-(ethoxycarbonylmethoxy-carbonyl)-phenethyl | yellow | 1.73 | ◎ |
| 34 | 2-[4-(3-ethoxycarbonylpropoxy-carbonyl)phenoxy]ethyl- | yellow | 1.87 | ◎ |
| 35 | 4-[2-[2-(2-hydroxyethoxy)ethoxy]-ethyl]phenoxycarbonylmethyl- | yellow | 1.96 | ◎ |

TABLE 2-continued (Dye I-2)

| No. | $R_7$ | Hue | Density | Resistance to light |
|---|---|---|---|---|
| 36 | 2-[2-[2-(2-hydroxyethoxy)ethoxy]-ethyl]phenoxycarbonylmethyl- | yellow | 2.09 | ◎ |
| 37 | 4-hydroxybenzyl- | yellow | 1.79 | ◎ |
| 38 | 2-hydroxybenzyl- | yellow | 1.63 | ◎ |
| 39 | 4-hydroxycarbonylbenzyl- | yellow | 1.54 | ◎ |
| 40 | 4-isopropylbenzyl- | yellow | 1.84 | ◎ |
| 41 | 4-(4-hydroxybutyl)benzyl- | yellow | 1.89 | ◎ |
| 42 | 4-dibutylaminobenzyl- | yellow | 1.96 | ◎ |
| 43 | 4-(2-ethoxycarbonylethoxy-carbonyl)benzyl- | yellow | 1.88 | ◎ |
| 44 | $C_3H_6OCOCH_3$ | yellow | 1.68 | ◎ |
| 45 | $C_3H_6OCOOCH_3$ | yellow | 1.59 | ◎ |
| 46 | $C_3H_6OCOOPh$ | yellow | 1.66 | ◎ |
| 47 | $C_3H_6OCOC_3H_7$ | yellow | 1.83 | ◎ |
| 48 | $C_3H_6OCOC_4H_9$ | yellow | 1.89 | ◎ |
| 49 | $C_3H_6COOCH_3$ | yellow | 1.70 | ◎ |
| 50 | $C_3H_6COOC_3H_7$ | yellow | 1.73 | ◎ |
| 51 | $C_4H_8OCOC_5H_{11}$ | yellow | 1.69 | ◎ |
| 52 | $C_4H_8OCOCH_3$ | yellow | 1.74 | ◎ |
| 53 | $C_4H_8COOCH_3$ | yellow | 1.79 | ◎ |
| 54 | $C_4H_6COOC_3H_7$ | yellow | 1.87 | ◎ |
| 55 | $C_3H_6OCOC_3H_7$-iso | yellow | 1.88 | ◎ |
| 56 | $C_4H_8OCOOC_5H_3$ | yellow | 1.73 | ◎ |
| 57 | $C_4H_8OCOOPh$ | yellow | 1.57 | ◎ |
| 58 | $C_6H_{12}OCOCH_3$ | yellow | 1.68 | ◎ |
| 59 | $C_6H_{12}COOCH_3$ | yellow | 1.55 | ◎ |
| 60 | $C_4H_8COOC_4H_9$-sec | yellow | 1.75 | ◎ |
| 61 | $C_3H_{12}OCOC_3H_7$ | yellow | 1.80 | ◎ |
| 62 | $C_5H_{10}OH$ | yellow | 1.69 | ◎ |
| 63 | $C_5H_{10}OCOCH_3$ | yellow | 1.71 | ◎ |
| 64 | $C_5H_{10}COOCH_3$ | yellow | 1.72 | ◎ |
| 65 | $C_3H_6OCOC_4H_9$-sec | yellow | 1.83 | ◎ |
| 66 | $C_3H_6OCOC_2H_5$ | yellow | 1.77 | ◎ |
| 67 | $C_7H_8OCOC_2H_5$ | yellow | 1.86 | ◎ |
| 68 | $C_3H_6COOC_2H_5$ | yellow | 1.71 | ◎ |
| 69 | 4-(3-piperidyl)butyl | yellow | 1.63 | ◎ |
| 70 | 4-(4-piperidylcarboxy)butyl- | yellow | 1.54 | ◎ |
| 71 | 4-(1-piperazinyloxycarboxy)butyl- | yellow | 1.69 | ◎ |
| 72 | 4-(2-piperazinyloxycarbonyl)butyl- | yellow | 1.59 | ◎ |
| 73 | 4-(morpholinylcarboxy)butyl- | yellow | 1.73 | ◎ |
| 74 | 4-(2-thienyloxy)butyl- | yellow | 1.51 | ◎ |
| 75 | 5-[5-(3-methyl-1-hexene)carboxy]-pentyl | yellow | 1.79 | ◎ |
| 76 | 4-(3-pyranyloxycarboxy)butyl- | yellow | 1.56 | ◎ |
| 77 | 6-(6-bicyclo[3,2,1]octoxy)hexyl- | yellow | 1.83 | ◎ |

TABLE 3

(Dye I-3)

| No. | $R_1$ | $R_2$ | $R_3$ | $R_4$ | $R_5$ | $R_7$ | R | Hue | Density | Resistance to light |
|---|---|---|---|---|---|---|---|---|---|---|
| 1 | —H | —H | —H | —H | —H | —$C_2H_5$ | —$C_2H_5$ | yellow | 2.12 | ○ |
| 2 | —H | —H | —H | —H | —H | —$C_4H_9$ | —Ph | yellow | 2.06 | ○ |
| 3 | —Cl | —H | —Cl | —H | —H | —$C_2H_5$ | —$C_2H_5$ | yellow | 2.19 | ○ |
| 4 | —SPh | —H | —H | —H | —H | —$C_2H_5$ | —$CH_2COOC_2H_5$ | yellow | 1.86 | ○ |
| 5 | —H | —SPh | —H | —H | —H | —$C_2H_5$ | —$C_2COOPh$ | yellow | 1.77 | ○ |
| 6 | —H | —H | —H | —$COOC_2H_5$ | —H | —$C_2H_5$ | —$C_2H_5$ | yellow | 1.69 | ○ |
| 7 | —H | —H | —H | —H | —Cl | —$C_2H_5$ | —$C_2H_5$ | yellow | 1.49 | ○ |
| 8 | —H | —H | —$NHCH_3$ | —$COOC_2H_5$ | —H | —$C_2H_5$ | —$C_2H_5$ | yellow | 1.54 | ○ |
| 9 | —H | —H | —H | —H | —H | —$C_2H_5$ | —$C_8H_{17}$ | yellow | 1.90 | ○ |
| 10 | —H | —H | —H | —H | —H | —$C_7H_{15}$ | —H | yellow | 1.92 | ○ |
| 11 | —H | —H | —H | —H | —H | —$C_2H_5$ | -sec-$C_4H_9$ | yellow | 1.84 | ○ |
| 12 | —H | —H | —H | —H | —H | —$C_4H_9$ | —$CH_2Ph$ | yellow | 1.93 | ○ |
| 13 | —H | —H | —Cl | —H | —H | —$C_2H_5$ | —$C_2H_5$ | yellow | 1.53 | ○ |

TABLE 4

(Dye I-4)

| No. | $R_1$ | $R_2$ | $R_3$ | $R_4$ | $R_5$ | $R_7$ | A | Hue | Density | Resistance to light |
|---|---|---|---|---|---|---|---|---|---|---|
| 1 | —H | —H | —H | —H | —H | $—C_2H_5$ | $—CONHC_2H_5$ | yellow | 1.52 | ∘ |
| 2 | —H | —H | —H | —H | —H | $—C_2H_5$ | 2-thiazolyl- | orange | 1.38 | ∘ |
| 3 | —H | —H | —H | —H | —H | $—C_2H_5$ | 2-pyridyl- | orange | 1.42 | ∘ |
| 4 | —H | —H | —H | —H | —H | $—C_2H_5$ | 2-benzoxazolyl- | orange | 1.35 | ∘ |
| 5 | —H | —H | —H | —H | —H | $—C_2H_5$ | 2-benzothiazolyl- | orange | 1.49 | ∘ |
| 6 | —H | —H | —H | —H | —H | $—C_2H_5$ | 3-ethyl-2-benzimidazolyl- | orange | 1.45 | ∘ |
| 7 | —H | —H | —H | —H | —H | $—C_2H_5$ | 3,3-dimethyl-3H-indole-2-yl | orange | 1.45 | ∘ |
| 8 | —H | —H | —SPh | —H | —H | $—C_4H_8OH$ | $—CONHC_2H_5$ | yellow | 1.67 | ∘ |
| 9 | —H | —H | $—CH_3$ | —H | —H | $—C_4H_8OH$ | $—CONHC_2H_5$ | yellow | 1.86 | ∘ |
| 10 | —H | —H | —H | —H | —H | $—C_4H_8OH$ | 3-ethyl-4,5-dicyano-2-imidazolyl | orange | 1.57 | ∘ |
| 11 | —H | —H | —H | —H | —H | $—C_4H_8OH$ | 5-(4-ethyl-3-cyano)-1,2,4-triazolyl)- | orange | 1.62 | ∘ |
| 12 | —H | —H | —H | —H | —H | $—C_4H_8OH$ | 2-(5-phenyl-1,3,4-oxadiazolyl)- | orange | 1.59 | ∘ |
| 13 | —H | —H | —H | —H | —Cl | $—C_4H_8OH$ | 2-(5-phenyl-1,3,4-oxadiazolyl)- | orange | 1.67 | ∘ |
| 14 | —H | —H | —H | $—CONHC_2H_4OCH_3$ | —H | $—C_4H_8OH$ | 2-benzothiazolyl- | orange | 1.54 | ∘ |

TABLE 5

(Dye I-5)

| No. | $R_7$ | X | Hue | Density | Resistance to light |
|---|---|---|---|---|---|
| 1 | $—C_8H_{16}OH$ | 1-phenyl-3-methyl-pyrazoline-5-one-4-ylidene | orange | 1.64 | ⊙ |
| 2 | $—C_8H_{16}OH$ | 1-phenyl-3-dimethyl-amino-pyrazoline-5-one-4-ylidene- | orange | 1.72 | ⊙ |
| 3 | $—C_8H_{16}OH$ | 1,2-diphenyl-pyrazolidine-3.5-dione-4-ylidene- | orange | 1.66 | ⊙ |
| 4 | $—C_8H_{16}OH$ | 1-butyl-3,3-dimethyl-2-indolynylidene- | orange | 1.58 | ⊙ |
| 5 | $—C_8H_{16}OH$ | 3-ethyl-2-benzoxazolynylidene- | orange | 1.59 | ⊙ |
| 6 | $—C_8H_{16}OH$ | 3-ethyl-2-benzothiazolynylidene- | orange | 1.67 | ⊙ |
| 7 | $—C_8H_{16}OH$ | 4,6-diphenyl-2H-pyran-2-ylidene- | orange | 1.44 | ⊙ |
| 8 | $—C_8H_{16}OH$ | 3-methyl-5-phenyl-2-oxadiazolynyliene- | orange | 1.39 | ⊙ |
| 9 | $—C_8H_{16}OH$ | 3-methyl-5-phenyl-2-thiadiazolynylidene- | orange | 1.67 | ⊙ |
| 10 | $—C_8H_{16}OH$ | 3-ethyl-4,5-dicyano-2-thiazolynylidene- | orange | 1.81 | ⊙ |
| 11 | $—C_8H_{16}OH$ | 1,3-diethyl-2-benzimidazolynylidene- | orange | 1.72 | ⊙ |
| 12 | $—C_8H_{16}OH$ | 1-butyl-2-pyridylidene- | orange | 1.44 | ⊙ |
| 13 | $—C_8H_{16}OH$ | 2-phenyl-thiazoline-4-one-5-ylidene- | orange | 1.53 | ⊙ |
| 14 | $—C_8H_{16}OH$ | 2-diethylamino-thiazoline-4-one-5-ylidene- | orange | 1.59 | ⊙ |
| 15 | $—C_8H_{16}OH$ | 1-butyl-3-phenyl-imidazolidine-2-thione-4-one-5-ylidene- | orange | 1.47 | ⊙ |
| 16 | $—C_8H_{16}OH$ | benzo-[b]-thiene 3-one-2-ylidene | orange | 1.52 | ⊙ |
| 17 | $—C_8H_{16}OH$ | 3-phenyl-thiazolidine-2-thione-4-one-5-ylidene- | orange | 1.43 | ⊙ |
| 18 | $—C_8H_{16}OH$ | 3-phenyl-thiazolidine-2,4-dione-5-ylidene- | orange | 1.49 | ⊙ |
| 19 | $—C_8H_{16}OH$ | 3-phenyl-oxazolidine-2-thione-4-one-5-ylidene- | orange | 1.52 | ⊙ |
| 20 | $—C_8H_{16}OH$ | -1,3-diphenyl-hexahydropyrimidine-2,4,6-trione-5-ylidene- | orange | 1.69 | ⊙ |
| 21 | $—C_8H_{16}OH$ | 2H-indene-1,3-dione-2-ylidene | orange | 1.73 | ⊙ |

TABLE 5-continued (Dye I-5)

| No. | $R_7$ | X | Hue | Density | Resistance to light |
|---|---|---|---|---|---|
| 22 | $-C_8H_{16}OH$ | 1-phenyl-4-pyridinylidene- | orange | 1.63 | ⊙ |
| 23 | -iso-$C_4H_9$ | $=C(COOCH_3)_2$ | orange | 1.69 | ∘ |
| 24 | $-C_2H_5$ | $=C(COOSiMe_3)_2$ | orange | 1.63 | ∘ |

TABLE 6

(Dye I-6)

| No. | $R_3$ | $R_4$ | $R_7$ | X | Hue | Density | Resistance to light |
|---|---|---|---|---|---|---|---|
| 1 | —H | $-CONHCH_3$ | $-C_8H_{17}$ | 1-phenyl-3-methyl-pyrazoline-5-one-4-ylidene | orange | 1.57 | ∘ |
| 2 | —S-phenyl | —H | $-C_8H_{16}OH$ | 1-phenyl-3-dimethylamino-pyrazoline-5-one-4-ylidene | orange | 1.66 | ∘ |
| 3 | —H | $-COOC_2H_4OC_2H_5$ | $-C_8H_{16}OH$ | 1-phenyl-3-dimethylamino-pyrazoline-5-are-4-ylidene- | orange | 1.72 | ∘ |
| 4 | —Cl | —H | $-C_8H_{16}OH$ | 1,2-diphenyl-pyrazolidine-3,5-dione-4-ylidene- | orange | 1.48 | ∘ |
| 5 | —H | —Cl | $-C_8H_{16}OH$ | 1,2-diphenyl-pyrazolidine-3,5-dione-4-ylidene- | orange | 1.53 | ∘ |
| 6 | —H | —S-phenyl | $-C_8H_{16}OH$ | 1-phenyl-3-methyl-pyrazoline-5-one-4-ylidene- | orange | 1.52 | ∘ |

The heat transfer sheet according to the present invention is characterized by comprising the above specific dye, and, except this point, it can have the same structure as that of a conventionally-known heat transfer sheet. Any known material having both heat resistance and mechanical strength in some degree can be employed as the substrate sheet of the heat transfer sheet of the present invention. For instance, ordinary paper, coated paper of various kinds, a polyester film, a polystyrene film, a polypropylene film, a polysulfone film, a polycarbonate film, an aramide film, a polyvinyl alcohol film and a cellophane film are employable. Of these, a polyester film is preferred. The thickness of the substrate sheet is approximately from 0.5 to 50 μm, preferably from 3 to 10 μm.

The dye layer provided on the surface of the above substrate sheet is a layer in which the dye having formula (I) is supported by a binder resin.

Any known resin can be used as the binder resin which supports the above dye. Preferable examples of the binder resin include cellulose resins such as ethyl cellulose, hydroxyethyl cellulose, ethylhydroxy cellulose, hydroxypropyl cellulose, methyl cellulose, cellulose acetate and cellulose butyrate, and vinyl resins such as polyvinyl alcohol, cellulose polyacetate, polyvinyl butyral, polyvinyl acetal, polyvinyl pyrrolidone and polyacryl amide. Of these resins, polyvinyl butyral and polyvinyl acetal are particularly preferred from the viewpoints of heat resistance and migration of the dye.

The dye layer of the heat transfer sheet according to the present invention is basically formed using the above-described materials. However, the dye layer can further comprise, if necessary, various additives which have been used for conventional heat transfer sheets. The dye layer can be provided on the substrate sheet in the following preferable manner:

The above-described dye and binder resin, and, if necessary, some additives are dissolved or dispersed in a proper organic solvent to obtain a coating liquid or ink for forming a dye layer. The coating liquid or ink is coated onto a substrate sheet, and then dried. A dye layer can thus be formed on the substrate sheet.

The thickness of the dye layer thus formed is approximately from 0.2 to 5.0 μm, preferably from 0.4 to 2.0 μm. The amount of the dye contained in the dye layer is from 5% to 70% by weight, preferably from 10% to 60% by weight of the total weight of the dye layer.

The heat transfer sheet according to the present invention can be used for heat transfer printing as it is. However, an adhesion-protective layer, that is, a releasing layer may further be provided on the surface of the dye layer. Such a layer can prevent the heat transfer sheet from adhering to an image-receiving sheet when heat transfer printing is conducted. In addition, an image having a higher density can be obtained by making use of a higher operation temperature.

Even a dye layer simply covered with an adhesion-protective inorganic powder reveals sufficiently high releasing ability. It is, however, more suitable to form a releasing layer using a resin having high releasing ability such as a silicone polymer, an acrylic polymer or a fluorinated polymer. In this case, the thickness of the releasing layer is from 0.01 to 5 μm, preferably from 0.05 to 2 μm.

Instead or providing the releasing layer, the inorganic powder or the above-described resin having releasing ability may be incorporated into the dye layer. Even by such a manner, sufficiently high releasing ability can be imparted to the heat transfer sheet of the present invention.

Furthermore, a heat-resistive layer may be provided on the back surface of the heat transfer sheet of the invention. The heat-resistive layer can eliminate adverse effects of heat which is generated by a thermal head.

Any heat transfer image-receiving sheet whose recording surface is receptive to the above dye can be used in combination with the heat transfer sheet of the present invention for image printing. Even those materials which are not receptive to the dye, such as paper, metals, glass and synthetic resins can also be used as heat transfer image receiving sheets if they are provided with a dye-receiving layer on at least one surface thereof.

To conduct heat transfer printing using the heat transfer sheet according to the present invention and the above-described heat transfer image-receiving sheet in combination, any conventional means for applying thermal energy is employable. For instance, recording apparatus such as a thermal printer, "Video Printer VY-100" (Trademark) manufactured by Hitachi Co., Ltd., are employable for the purpose. A desired image can be obtained by applying thermal energy in an amount of approximately 5 to 100 mJ/mm$^2$, which is controllable by changing the printing time, by the thermal printer to the heat transfer sheet.

The heat transfer sheet of the present invention produces an image of a yellow color. Therefore, a full-colored image is obtainable with high color-reproducibility when the heat transfer sheet of the invention is used in combination with a heat transfer sheet comprising a magenta dye and that comprising a cyan dye.

The present invention will now be explained more specifically with reference to Examples and Comparative Examples. However, the following Examples should not be construed as limiting the present invention. Throughout the examples, quantities expressed in "parts" or "percent (%)" are on the weight basis, unless otherwise indicated.

REFERENTIAL EXAMPLE 1

16.9 g of N-ethyl-benz[cd]indole-2(1H)one, 6 g of malononitrile and 19.4 g of phosphorus oxychloride were added to 150 ml of toluene, and the mixture was heated on a water bath for four hours while stirring. The reaction mixture was poured into 600 ml of methanol. The crystalline precipitate was collected by filtration, and recrystallized from a solvent mixture of chloroform and methanol, whereby a yellow crystalline product, Dye No. 75 shown in Table 1, was finally obtained. The absorption maximum wave length and the melting point of the dye were 441 nm (methanol) and 196° to 197° C., respectively.

REFERENCE EXAMPLE 2

9.3 g of a quaternary salt having the following formula:

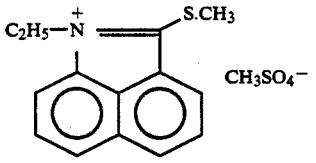

and 3.4 g of ethyl cyanoacetate ester were added to 85 ml of acetonitrile. To the resulting mixture, 5.3 ml of triethylamine was added, and the mixture was refluxed for one hour while heating. After the solvent was distilled off, methanol was added to the mixture. The crystalline precipitate was collected by filtration, and purified by a silica gel column chromatography, whereby a yellow crystalline product, Dye No. 1 shown in Table 3, was finally obtained. The absorption maximum wave length and the melting point of the dye were 454 nm (methylene chloride) and 86° to 87° C., respectively.

REFERENTIAL EXAMPLE 3

The dyes shown in Tables 1 to 6 were respectively prepared using the corresponding starting materials by the same procedure as that of Referential Example 1 or 2.

EXAMPLE

Preparation of Heat Transfer Sheets

Ink compositions for forming a dye layer, having the following formulation were prepared. Each of the ink compositions was coated onto the surface of a substrate sheet, a polyethylene terephthalate film having a thickness of 6 μm with its back surface imparted with heat-resistivity, in an amount of 1.0 g/m$^2$ on dry basis, and then dried, whereby heat transfer sheets according to the present invention were obtained.

| <Formulation of Ink Composition> | |
|---|---|
| Dye shown in Tables 1 to 6 | 3 parts |
| Polyvinyl butyral resin | 4.5 parts |
| Methyl ethyl ketone | 46.25 parts |
| Toluene | 46.25 parts |

It is noted that a solvent such as DMF, dioxane or chloroform was properly used when the dye was insoluble in the above ink composition. In the case where the dye could not be thoroughly dissolved in the composition even when such a solvent was used, a filtrate of the composition was employed as the ink composition.

Preparation of Heat Transfer Image-Receiving Sheet

A coating liquid for forming a dye-receiving layer, having the following formulation was coated onto one surface of a substrate sheet, synthetic paper "Yupo FPG #150" ( Trademark ) manufactured by Oji-Yuka Synthetic Paper Co., Ltd., in an amount of 10.0 g/m$^2$ on dry basis, and then dried at a temperature of 100° C. for 30 minutes, whereby a heat transfer image-receiving sheet was obtained.

| <Formulation of Coating Liquid> | |
|---|---|
| Polyester resin ("Vylon 200" (Trademark) manufactured by Toyobo Co., Ltd.) | 11.5 parts |
| Vinyl chloride - Vinyl acetate copolymer ("VYHH" (Trademark) manufactured by UCC) | 5.0 parts |
| Amino-modified silicone ("KF-393" (Trademark) manufactured by Shin-Etsu Chemical Co., Ltd.) | 1.2 parts |
| Epoxy-modified silicone ("X-22-343" (Trademark) manufactured by Shin-Estu Chemical Co., Ltd.) | 1.2 parts |
| Methylethyl ketone/Toluene/Cyclohexane (weight ratio = 4:4:2) | 102.0 parts |

Printing Test

Each of the heat transfer sheets was superposed on the heat transfer image-receiving sheet so that the dye layer of the heat transfer sheet faced the dye-receiving layer of the image-receiving sheet. Thermal energy was then applied to the back surface of the heat transfer sheet by a thermal head under the following conditions:

| | |
|---|---|
| Electric voltage applied: | 10 V |
| Printing time: | 4.0 msec |

Images thus obtained were evaluated in terms of the density and resistance to light. The results are shown in Tables 1 to 6.

COMPARATIVE EXAMPLES 1 to 6

The procedure of Example was repeated except that the dyes used in Example were replaced by the dyes shown in Table 7, whereby comparative heat transfer sheets were respectively obtained.

The heat transfer sheets thus obtained were evaluated in the same manner as in Example. The results are shown in Table 7.

TABLE 7

| Dye for Comparative Example | Density | Resistance to light |
|---|---|---|
| Comparative Example 1 Dye 1: yellow | 1.77 | x |
| Comparative Example 2 Dye 2: yellow | 2.32 | x |
| Comparative Example 3 Dye 3: yellow | 2.19 | x |
| Comparative Example 4 Dye 4: yellow | 1.75 | x |
| Comparative Example 5 Dye 5: yellow | 1.48 | x |

Dye 1: $CH_3OOC$

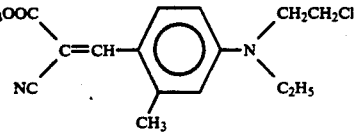

Dye 2: C.I. Solvent Yellow 56
Dye 2: C.I. Solvent Yellow 14
Dye 3: C.I. Disperse Yellow 3
Dye 5: C.I. Disperse Yellow 54

In the above Example and Comparative Examples, the density of the printed image was measured by a densitometer "RD-918" (Trademark) manufactured by MacBeth Corporation in U.S.A.

The light resistance of the image was evaluated by exposing the image to the light of a xenon lamp (1200 W) for 40 hours, and determining the rate of the dye remaining in the image. The evaluation standard is as follows:

o: 80% or more of the dye is remaining in the image
O: 79% to 50% of the dye is remaining in the image
X: less than 50% of the dye is remaining in the image

INDUSTRIAL APPLICABILITY

As described above, by the use of the dye with a specific structure, a heat transfer sheet that can produce an image even when thermal energy is applied thereto in an extremely short time and that can produce an image having a high density and excellent fastness properties, and, in particular, an image which is excellent in resistance to light and is free from bleeding (migration) to the reverse side of an image-receiving sheet can be obtained.

We claim:

1. A heat transfer sheet comprising:

a substrate sheet; and a dye layer provided on one surface of the substrate sheet, the dye layer comprising a dye of the formula:

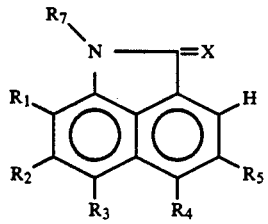

wherein

X is any of $=C(COOR_7)_2$, wherein the $R_7$ groups may be the same or different, or

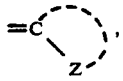

in which

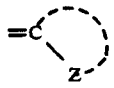

is a residual group of a five-membered ring that may have a condensed ring, and

Z is —CO—, $—NR_6—$, —S—, —O— or —NH—, $R_1$ is any of a hydrogen atom, $R_6$, a halogen atom, a nitro group, $—OR_6$, $—SR_6$, or an allyl group which may have a substituent;

$R_2$ is any of a hydrogen atom, a halogen atom, $—OR_6$, or $—SR_6$;

$R_3$ is any of a hydrogen atom, $R_6$, a halogen atom, a nitro group, an allyl group which may have a substituent, $—OR_6$, $—SR_6$, a sulfamoyl group, a carbamoyl group, an acyl group, an acylamide group, a sulfone amide group, an ureido group, or $—NR_6R_6$ wherein the $R_6$ groups may be the same or different;

$R_4$ is any of a hydrogen atom, a halogen atom, $—OR_6$, $—SR_6$, a cyano group, $—COOR_6$, a carbamoyl group, or a sulfamoyl group;

$R_5$ is any of a hydrogen atom, a halogen atom, $—OR_6$, or $—SR_6$;

$R_6$ is any of an alkyl group which may have a substituent, an aryl group which may have a substituent, a cycloalkyl group which may have a substituent or a heterocyclic ring which may have a substituent; and $R_7$ is any of a hydrogen atom, $—R_6$, an allyl group which may have a substituent, an alkenyl group which may have a substituent, a heteroalkenyl group which may have a substituent, an arylalkylene group which may have a substituent, a heteroaryl-alkylene group which may have a substituent, an alkoxyalkylene group which may have a substituent, an oxycarbonylalkyl group which may have a substituent, a carboxyalkyl group which may have a substituent, an oxycarboxyalkyl group which may have a substituent or a cycloalkylalkylene group which may have a substituent, with the proviso that any two adjacent groups among $R_1$, $R_2$, $R_3$, $R_4$ and $R_5$ may form a ring.

2. A heat transfer sheet for use in thermal transfer printing by means of a thermal printer, comprising:

a substrate sheet; and a dye layer provided on one surface of the substrate sheet, the dye layer comprising a dye of the formula:

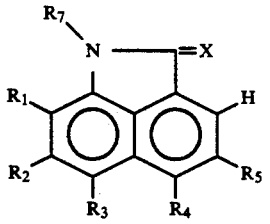

wherein

X is any of

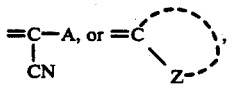

in which

A is an electron attracting group,

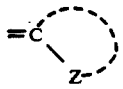

is a residual group of a six-membered ring that may have a condensed ring, and

Z is —CO—, —$NR_6$—, —S—, —O— or —NH—, $R_1$ is any of hydrogen atom, $R_6$, a halogen atom, a nitro group, —$OR_6$, —$SR_6$, or an allyl group which may have a substituent;

$R_2$ is any of a hydrogen atom, a halogen atom, —$OR_6$, or —$SR_6$;

$R_3$ is any of a hydrogen atom, $R_6$, a halogen atom, a nitro group, an allyl group which may have a substituent, —$OR_6$, —$SR_6$, a sulfamoyl group, a carbamoyl group, an acyl group, an acylamide group, a sulfone amide group, an ureido group, or —$NR_6R_6$ wherein the $R_6$ groups may be the same or different;

$R_4$ is any of a hydrogen atom, a halogen atom, —$OR_6$, —$SR_6$, a cyano group, —$COOR_6$, a carbamoyl group, or a sulfamoyl group;

$R_5$ is any of a hydrogen atom, a halogen atom, —$OR_6$, or —$SR_6$;

$R_6$ is any of an alkyl group which may have a substituent, an aryl group which may have a substituent, a cycloalkyl group which may have a substituent or a heterocyclic ring which may have a substituent; and $R_7$ is any of a hydrogen atom, —$R_6$, an allyl group which may have a substituent, an alkenyl group which may have a substituent, a heteroalkenyl group which may have a substituent, an arylalkylene group which may have a substituent, a heteroaryl-alkylene group which may have a substituent, an alkoxyalkylene group which may have a substituent, an oxycarbonylalkyl group which may have a substituent, a carboxyalkyl group which may have a substituent, an oxycarboxyalkyl group which may have a substituent or a cycloalkylalkylene group which may have a substituent, with the proviso that any two adjacent groups among $R_1$, $R_2$, $R_3$, $R_4$ and $R_5$ may form a ring.

3. A thermal transfer assemblage for use in thermal transfer printing by means of a thermal printer, comprising (a) an image-receiving sheet and (b) a heat transfer sheet comprising:

a substrate sheet; and a dye layer provided on one surface of the substrate sheet, the dye layer comprising a dye of the formula:

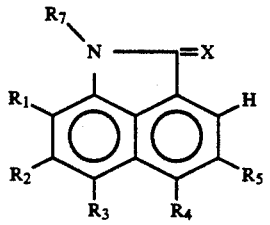

wherein

X is any of

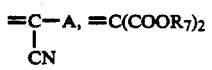

wherein the $R_7$ groups may be the same or different, or

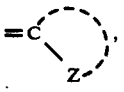

in which

A is an electron attracting group,

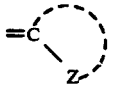

is a residual group of a five- or six-membered ring that may have a condensed ring, and Z is —CO—, —$NR_6$—, —S—, —O— or —NH—, $R_1$ is any of a hydrogen atom, $R_6$, a halogen atom, a nitro group, —$OR_6$, —$SR_6$, or an allyl group which may have a substituent;

$R_2$ is any of a hydrogen atom, a halogen atom, —$OR_6$, or —$SR_6$;

$R_3$ is any of a hydrogen atom, $R_6$, a halogen atom, a nitro group, an allyl group which may have a substituent, —$OR_6$, —$SR_6$, a sulfamoyl group, a carbamoyl group, an acyl group, an acylamide group, a sulfone amide group, an ureido group, or —$NR_6R_6$ wherein the $R_6$ groups may be the same or different;

$R_4$ is any of a hydrogen atom, a halogen atom, —$OR_6$, —$SR_6$, a cyano group, —$COOR_6$, a carbamoyl group, or a sulfamoyl group;

$R_5$ is any of a hydrogen atom, a halogen atom, —$OR_6$, or —$SR_6$;

$R_6$ is any of an alkyl group which may have a substituent, an aryl group which may have a substituent, a cycloalkyl group which may have a substituent or a heterocyclic ring which may have a substituent; and $R_7$ is any of a hydrogen atom, —$R_6$, an allyl group which may have a substituent, an alkenyl group which may have a substituent, a heteroalkenyl group which may have a substituent, an arylalkylene group which may have a substituent, a heteroaryl-alkylene group which may have a substituent, an alkoxyalkylene group which may have a substituent, an oxycarbonylalkyl group which may have a substituent, a carboxyalkyl group which may have a substituent, an oxycarboxyalkyl group which may have a substituent or a cycloalkylalkylene group which may have a substituent, with the proviso that any two adjacent groups among $R_1$, $R_2$, $R_3$, $R_4$ and $R_5$ may form a ring.

4. A process for thermal transfer printing comprising the steps of:

(i) providing an image-receiving sheet and a heat transfer sheet comprising:

a substrate sheet; and a dye layer provided on one surface of the substrate sheet, the dye layer comprising a dye of the formula:

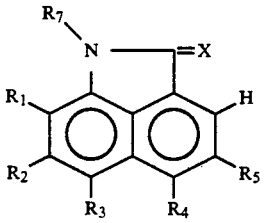

wherein

X is any of

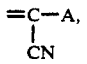

$C(COOR_7)_2$ wherein the $R_7$ groups may be the same or different), or

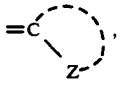

in which

A is an electron attracting group,

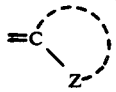

is a residual group of a five- or six-membered ring that may have a condensed ring, and Z is —CO—, —$NR_6$—, —S—, —O— or —NH—, $R_1$ is any of a hydrogen atom, $R_6$, a halogen atom, a nitro group, —$OR_6$, —$SR_6$, or an allyl group which may have a substituent;

$R_2$ is any of a hydrogen atom, a halogen atom, —$OR_6$, or —$SR_6$;

$R_3$ is any of a hydrogen atom, $R_6$, a halogen atom, a nitro group, an allyl group which may have a substituent, —$OR_6$, —$SR_6$, a sulfamoyl group, a carbamoyl group, an acyl group, an acylamide group, a sulfone amide group, an ureido group, or —$NR_6R_6$ wherein the $R_6$ groups may be the same or different;

$R_4$ is any of a hydrogen atom, a halogen atom, —$OR_6$, —$SR_6$, a cyano group, —$COOR_6$, a carbamoyl group, or a sulfamoyl group;

$R_5$ is any of a hydrogen atom, a halogen atom, —$OR_6$, or —$SR_6$;

$R_6$ is any of an alkyl group which may have a substituent, an aryl group which may have a substituent, a cycloalkyl group which may have a substituent or a heterocyclic ring which may have a substituent; and $R_7$ is any of a hydrogen atom, —$R_6$, an allyl group which may have a substituent, an alkenyl group which may have a substituent, a heteroalkenyl group which may have a substituent, an arylalkylene group which may have a substituent, a heteroaryl-alkylene group which may have a substituent, an alkoxyalkylene group which may have a substituent, an oxycarbonylalkyl group which may have a substituent, a carboxyalkyl group which may have a substituent, an oxycarboxyalkyl group which may have a substituent or a cycloalkylalkylene group which may have a substituent, with the proviso that any two adjacent groups among $R_1$, $R_2$, $R_3$, $R_4$ and $R_5$ may form a ring;

(ii) bringing the heat transfer sheet into contact with the image-receiving sheet; and (iii) applying thermal energy to the heat transfer sheet, in accordance with information for printing, thereby forming an image on the image-receiving sheet.

* * * * *